United States Patent [19]

Weaver

[11] Patent Number: 4,575,876

[45] Date of Patent: Mar. 18, 1986

[54] JACKET WITH SLEEPING BAG

[76] Inventor: David C. Weaver, 1321 E. Nevada St., El Paso, Tex. 79902

[21] Appl. No.: 674,968

[22] Filed: Nov. 26, 1984

[51] Int. Cl.[4] ..... A41B 1/12

[52] U.S. Cl. ..... 2/69.5; 5/448

[58] Field of Search ..... 2/69.5, 93, 86, 69, 2/72, 95, 96, 97–98; 5/343

[56] References Cited

U.S. PATENT DOCUMENTS

| | | | |
|---|---|---|---|
| 2,437,223 | 12/1945 | Dutrow | 2/94 |
| 2,644,948 | 1/1951 | Gutmann | 2/69.5 |
| 4,103,377 | 8/1978 | Mayer et al. | 2/69.5 |
| 4,125,910 | 11/1978 | Nicholai | 5/343 |
| 4,158,892 | 6/1979 | Gonzales | 2/69.5 |
| 4,310,925 | 1/1982 | York et al. | 2/69.5 |

FOREIGN PATENT DOCUMENTS

| | | | |
|---|---|---|---|
| 2397799 | 3/1979 | France | 2/69.5 |

*Primary Examiner*—Doris L. Troutman

[57] ABSTRACT

This invention involves a coat with a built-in-sleeping bag. The sleeping bag is attached to an ordinary jacket in place of the back coat lining. When not in use, the sleeping bag is folded inconspicuously inside the back of the coat. When the need arises, the bag may be unfolded and used as a conventional sleeping bag or as a coat-sleeping bag combination whereby the coat's sleeves are used in a normal fashion.

6 Claims, 4 Drawing Figures

Fig. 1
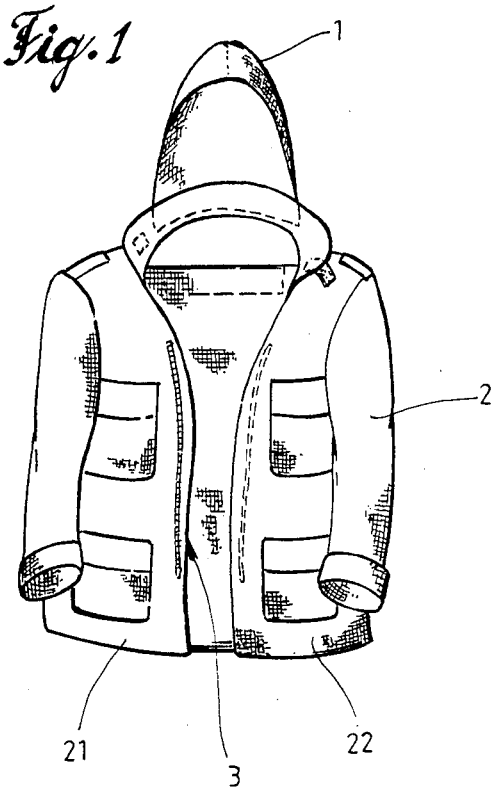
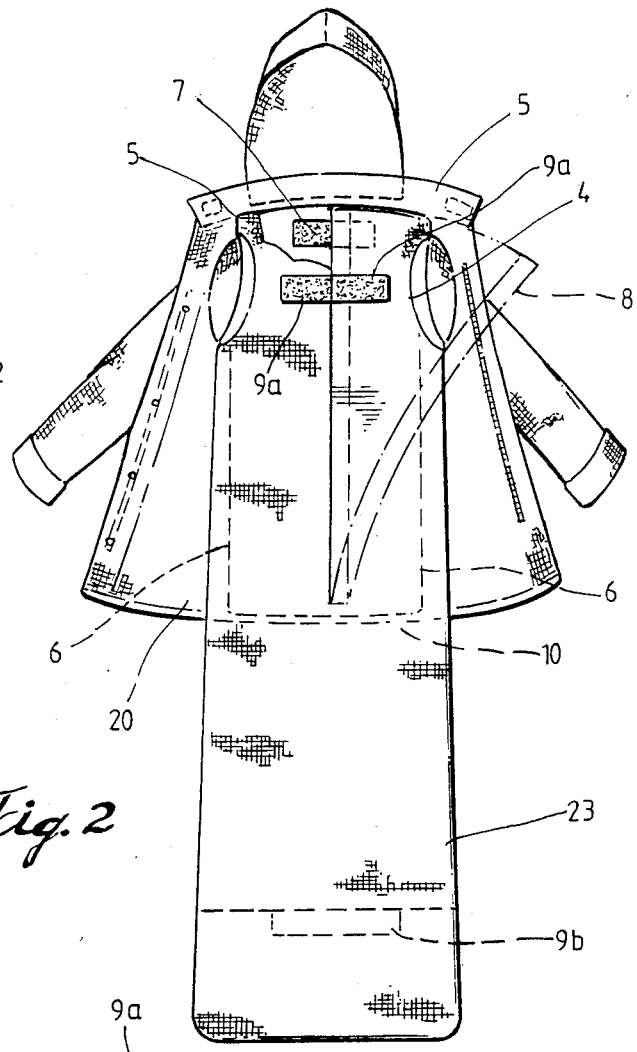
Fig. 2
Fig. 3
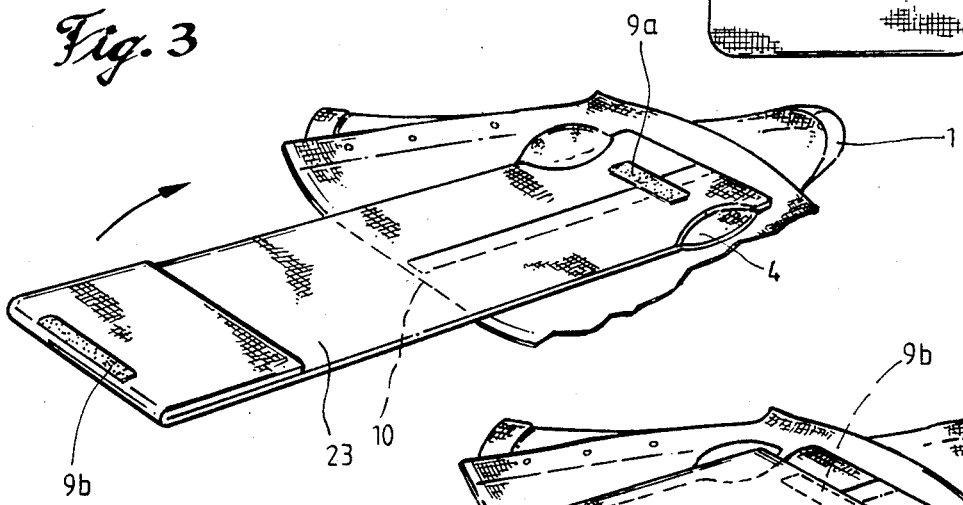
Fig. 4
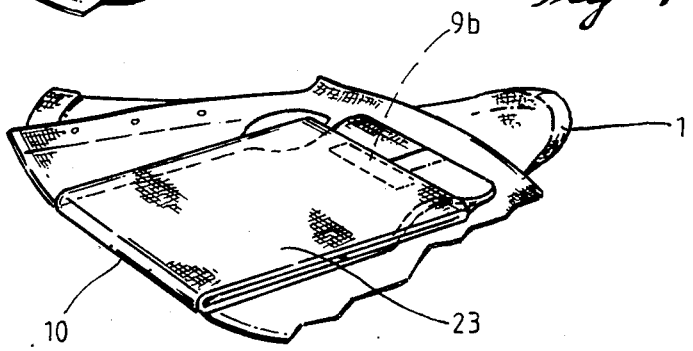

JACKET WITH SLEEPING BAG

BACKGROUND OF THE INVENTION

1. Field of the Invention

This invention pertains generally to apparel for outdoors activities. This invention allows an outdoorsman to carry cold weather apparel with a minimum of preparation and duplication. More specifically, the invention is directed toward eliminating the need to carry the sleeping bag as a separate object. The wearer's jacket and sleeping bag are modified in a novel manner to provide a single garment which may conveniently be used during physical activity or at rest.

2. Description of the Prior Art

Various attempts have been made in the prior art to produce garments that have multiple uses, but they either fail to perform the function of a single garment jacket and sleeping bag or they require an elaborate series of adjustments to produce the desired effect.

U.S. Pat. No. 2,437,223, discloses a hunter's coat with a removable flap. The flap may be attached outside the coat where its bright color is intended to identify its wearer as a human to other hunters. It is attached to the bottom edge of the coat and may be folded up inside the coat for easy storage. The flap may also be left hanging to provide a water-proof place upon which to sit.

Other multiple use garments are illustrated in U.S. Pat. Nos. 2,644,948; 4,158,892; and 4,310,925. All of these references describe garments which rely on specialized slits and multiple fasteners to shape an essentially flat piece or series of flat pieces of fabric into varying shapes.

U.S. Pat. No. 4,125,910 describes a sleeping bag with arm and leg slots that give the wearer limited mobility inside the sleeping bag. This item can not be worn as a jacket and is unsuitable for more than very limited activity.

U.S. Pat. No. 4,103,377 describes a knapsack-parka sleeping bag. An extendable insulated knapsack can be attached to a parka to form a sleeping bag. When a person is in the sleeping bag the parka may be worn as a coat with the arms extended, or the arms may be withdrawn from the parka sleeves for a more conventional sleeping bag effect. The user of this device must carry the bulky package of the knapsack when it is not in use as a sleeping bag.

SUMMARY OF THE INVENTION

This invention comprises a jacket in combination with a sleeping bag. An important aspect of the invention is its flexibility and ease of handling. When the sleeping bag is not in use, it may be simply folded up and stored in the back of the jacket. In this configuration, the sleeping bag serves as a liner for the jacket. The wearer's hands and shoulders remain free of encumbering packages. In addition, the bag acts as extra insulation to the jacket itself.

Another feature of this invention is that the jacket portion has maximum utility. Thus, when the garment is being used as a sleeping bag, the wearer may also use the jacket for extra insulation.

The jacket may be made of conventional materials and construction. What might normally be part of the back liner of the jacket has been replaced by a sleeping bag, whose top has been modified to conform to the inner contours of the jacket. The sleeping bag has a neckline and arm holes that correspond to those of the jacket. The sleeping bag also has a lengthwise opening for easy access. The sleeping bag may be fastened into the jacket permanently by way of seams or releasably, with a zipper, snaps, VELCRO fastener or other fasteners. The sleeping bag also has a number of additional fasteners, including at least one to hold the inside front against the inside back of the sleeping bag, and one to hold the folded bag within the back of the jacket.

BRIEF DESCRIPTION OF THE DRAWINGS

FIG. 1 is a frontal view of the jacket closed and the sleeping bag folded up as would be the case during physical activity.

FIG. 2 is a frontal view of the jacket open with the sleeping bag unfolded, as would be the case for sleeping.

FIG. 3 is a cutaway view of the jacket with the sleeping bag partially folded.

FIG. 4 is a cutaway figure of the jacket with the sleeping bag completely folded into the back of the jacket.

DESCRIPTION OF THE PREFERRED EMBODIMENTS

Referring to FIG. 1, the jacket portion of this invention may be of conventional construction and materials with respect to its outward appearance. The jacket comprises a back panel 20 and two front panels 21 and 22. A hood 1 and sleeves 2 are optional features. The front opening 3 may be fastened by any number of means including but not limited to buttons, zippers, snaps, and VELCRO fasteners.

In FIG. 2, the jacket is opened and sleeping bag 23 fully extended to show details of the construction of the present invention. The upper portion of the sleeping bag 23 is modified to conform generally to the inner contours of the jacket. Thus, the bag 23 may have arm holes 4 that correspond with those of the jacket, and a shoulder area 5 that is fitted into the shell of the jacket. The upper back area 6 of the bag 23 is similarly fitted to the back panel 20 of the jacket. The shoulder area 5 and the upper back area 6 are fastened to the jacket by suitable means known to the clothier's art, such means including but not limited to a seam along the nape or collar line of the jacket, or a seam extending from the outer edge of one shoulder, across the nape line to the outer edge of the other shoulder. Releasable fasteners such as zippers, snaps or VELCRO fasteners may be used in place of fixed seams if so desired. The front section of the bag may be releasably fastened to the back section of the bag by suitable fasteners 7 on the back surface of the upper back area 6 and the front surface of the back panel 20.

The sleeping bag 23 is shown in FIG. 2 with a longitudinal front opening 8 for ease in entering the bag. Variations on the location of the opening and its mode of fastening will be readily apparent to those skilled in the art.

A set of snaps or other suitable fasteners **9*a* and 9*b* is used to hold bag 23 in a folded configuration within the jacket. Fasteners 9*a* and 9*b* are shown located at the upper front and lower back sections of the sleeping bag. It will be noted that the fastener 9*b* may be located in any of several positions, depending on the number and locations of the folds made in bag 23** to position it within the jacket.

In FIG. 3, the jacket is shown laid open and the sleeping bag partially folded. Fastener 7 is closed as is longitudinal opening 8. The bag will be folded along fold line 10 for storage. Fold line 10 is preferably located within but near the bottom hem of the jacket.

In FIG. 4, the sleeping bag is shown a fully folded position. Fasteners 9*a* and 9*b* are now joined, and the jacket is ready to be worn for physical activity.

In the practice of this invention, the user may wear the jacket with the sleeping bag 23 stored within the back of the jacket. The wearer then need not encumber his hands or shoulders with the bulk of the sleeping bag. When worn in this manner, the sleeping bag serves as extra insulation, and also as a pad to relieve the pressure of a back pack. When the use of the bedroll is desired, to sleep, for example, or when an outdoorsman intends to remain stationary for sometime, the user takes off the jacket, opens fasteners 9*a* and 9*b*, unfolds the sleeping bag 23, unfastens longitudinal opening 8, and opens fastener 7. The user slips within the sleeping bag and may place his arms through arm holes 4 in the sleeping bag and into the jacket sleeves 2. Alternatively, the user may choose to keep his arms entirely within the sleeping bag.

The foregoing description has been directed to particular embodiments of the present invention in accordance with the Patent Statute for purposes of illustration and explanation. It will be appreciated that other modifications of the present invention may be made by persons skilled in the art without departing from the spirit and scope of the invention. For example, the sleeping bag may be releasably attached to the inner surface of the jacket by means of a zipper or other cooperative fastener. This embodiment has the feature of having the bedroll fully removable from the jacket. It is intended that the following claims be interpreted to embrace all such modifications.

What is claimed is:

1. Outdoor apparel comprising:

(a) a garment for covering at least a portion of the human torso, the garment having a back panel, front panels, and two arm receiving passages;

(b) a liner attached to the garment adapted to enclose the human figure; said liner comprising a back section and a front section defining a first opening at the nape and two arm receiving regions; an areal portion of the back section of said, liner overlying and joined to said back panel of said garment; the remaining portions of said liner being foldable to fit against said front section of said liner and within an area defined by said back panel of said garment; and (c) a first closure device to releasably hold said folded portions of said liner against the front section of said liner and within said back panel of said garment.

2. Outdoor apparel as recited in claim 1 wherein the front section of said liner is divided substantially longitudinally to define a second opening; and wherein a second closure device is positioned on the back surface of the front section of said liner to releasably hold the top portion of said front section of said liner to the top portion of the front surface of the back section of said liner.

3. Outdoor apparel as recited in claim 1 in which said first closure device comprises a first VELCRO fastener along a lower portion of the back section of the said liner and a second VELCRO fastener along an upper portion of the front section of said liner, said first and second fasteners positioned to engage one another when the lower portion of said liner has been folded into said garment.

4. Camping apparel comprising:

(a) a jacket having a back panel, front panels, and two arm receiving passages, the back panel having an upper end, a bottom end and left and right sides;

(b) a liner having back and front sections wider and longer than said back panel of the jacket and joined to the jacket along the upper end of the back section of said liner and along the upper inner end of said back panel of the jacket; an areal portion of the back section of said liner bounded along the top by said joined portion which is overlying and integral with said back panel of the jacket in an areal portion of said back panel bounded by said upper inner end, the bottom end and the left and right sides of said back panel; the remaining portions of said liner being longitudinally and laterally foldable to fit within said jacket against said areal portion of said back of said liner; and (c) a first closure device to releasably hold said folded portions of said liner against said areal portion of said back of said liner.

5. Camping apparel as recited in claim 4 wherein the front section of said liner is divided lengthwise from the top end of said front section toward the bottom end of said front section to provide an occupant access into and out of said liner, and wherein a second closure device is positioned on said front section of said liner to releasably hold the divided portions of said front section of said liner together.

6. Camping apparel as recited in claim 4 in which said first closure device comprises a first VELCRO fastener along a lower portion of the back section of said liner and a second VELCRO fastener across an upper portion of the front section of said liner, said first and second fasteners positioned to engage one another when the lower portion of said liner is folded into said jacket.

* * * * *